United States Patent [19]

Gounder et al.

[11] Patent Number: 5,038,568

[45] **Date of Patent: * Aug. 13, 1991**

[54] SYSTEM FOR REHEAT STEAM TEMPERATURE CONTROL IN CIRCULATING FLUIDIZED BED BOILERS

[75] Inventors: Ponnusami K. Gounder, San Diego; Neil R. Raskin, Carlsbad; Timo M. Kauranen, San Diego, all of Calif.

[73] Assignee: Pyropower Corporation, San Diego, Calif.

[ * ] Notice: The portion of the term of this patent subsequent to May 1, 2007 has been disclaimed.

[21] Appl. No.: 463,165

[22] Filed: Jan. 10, 1990

Related U.S. Application Data

[63] Continuation-in-part of Ser. No. 440,416, Nov. 20, 1989, Pat. No. 4,920,751, which is a continuation of Ser. No. 301,621, Jan. 24, 1989, abandoned.

[51] Int. Cl.[5] ..... F01K 13/02

[52] U.S. Cl. ..... 60/679; 60/663; 60/669

[58] Field of Search ..... 60/663, 669, 679

[56] References Cited

U.S. PATENT DOCUMENTS

| | | | |
|---|---|---|---|
| 4,318,366 | 3/1982 | Tompkins | 122/20 |
| 4,419,940 | 12/1983 | Cosar et al. | 110/229 |
| 4,419,965 | 12/1983 | Garcia-Mallol et al. | 122/4 |
| 4,453,495 | 6/1984 | Strohmeyer, Jr. | 122/4 |
| 4,489,679 | 12/1984 | Holt | 122/451 |
| 4,748,940 | 6/1988 | Hönig | 122/4 |
| 4,920,751 | 5/1990 | Gounder et al. | 60/679 |

FOREIGN PATENT DOCUMENTS 2099558A 12/1982 United Kingdom .

*Primary Examiner*—Allen M. Ostrager
*Attorney, Agent, or Firm*—Baker, Maxham, Jester & Meador

[57] ABSTRACT

A steam generator having a fluidized bed combustion system that includes a fluidized bed combustor and at least one hot separator, includes a superheater and a reheater with at least first and second or final stages disposed in a flue gas pass with the superheater upstream of the final stage reheater has a cold steam bypass system for controlling the temperature of the second or final stage reheater by dividing reheat steam into selective first and second portions and directing the first portion to the first stage reheater and recombining said first and second portions and directing them through the second or final stage reheater.

27 Claims, 2 Drawing Sheets

SYSTEM FOR REHEAT STEAM TEMPERATURE CONTROL IN CIRCULATING FLUIDIZED BED BOILERS

REFERENCE TO RELATED APPLICATIONS

The present application is a continuation-in-part of U.S. application Ser. No. 07/440,416, filed Nov. 20, 1989, now U.S. Pat. No. 4,920,751; which application was a continuation of U.S. Ser. No. 301,621, filed Jan. 24, 1989, and now abandoned.

BACKGROUND OF THE INVENTION

The present invention relates to circulating fluidized bed boilers and pertains particularly to a system and method for controlling reheat steam temperature.

Several methods are presently known for controlling reheat steam temperatures. One method of reheater temperature control is the use of a system for gas bypass over the reheater. Two separate flue gas passes are provided in the convection pass of the boiler (one for superheater and one for reheater), with means such as dampers downstream of each to vary the amount of flue gas flow over each section. The outlet steam temperature of the reheater can be controlled by varying the amount of flue gas flow between the convection pass sections. The main disadvantage of this system is that the dampers are located in a higher temperature (500–700 degrees F.), dust laden flue gas path making them susceptible to erosion and mechanical failure. Also, the steam temperature control range is limited with this type of system.

Another method of reheater outlet steam temperature control is by the use of external heat exchangers. With this approach, a portion of the recirculated solids within the circulating fluidized bed system is diverted to an externally mounted fluidized bed heat exchanger, i.e. external heater exchanger (EHE), in which a section of or complete reheater is located. By varying the amount of solids flow to the EHE, the quantity of heat transfer to the reheater and the reheater outlet steam temperature is controlled. The main disadvantages of this system are that the solids flow control valve is a high maintenance item, and the reheat tube surface within the EHE is subject to erosion. This effects the availability of the unit.

A further approach to the control of the reheater outlet steam temperature is by the use of spray desuperheater. This approach utilizes spraying water for desuperheating, and thereby controlling reheater outlet steam temperature. This is a simple approach, but not generally accepted, because it degrades the cycle efficiency.

Still another approach is by the use of excess air. Excess air supplied to the boiler can be used for reheat steam temperature control. This approach, however, is not favored because of its negative affect on boiler efficiency.

A still further approach is by the use of gas recirculation. By this approach, large quantities of flue gases are recirculated to achieve the rated reheater outlet steam temperature. This approach, however, requires the use of a gas recirculation fan for handling a hot dust laden gas and requires additional power consumption, which makes this approach disadvantageous.

In our prior application, we disclose and claim a steam generator having a fluidized bed combustion system that includes a fluidized bed combustor, at least one separator, and a reheater in a flue gas pass having at least first and second or final stages (possibly more), and includes means for controlling the temperature of the second or final stage of the reheater comprising of a means for bypassing a selected portion of cold steam around said first stage reheater directly to said second or final stage reheater. We have discovered a rearrangement of the superheater and reheater that enables the reheater to pick up more heat at lower loads and potentially extend its steam temperature control range. This system will also enhance the coupling of two units to one turbine easier as to temperature matching capabilities.

Accordingly, the present invention is directed to an improved method and system for reheat steam temperature control.

SUMMARY AND OBJECTS OF THE INVENTION

It is the primary object of the present invention to provide an improved system and method for controlling the reheater (outlet) steam temperature in circulating fluidized bed boilers.

In accordance with a primary aspect of the present invention, a steam generator having a fluidized bed combustion system that includes a fluidized bed combustor, at least one separator, and a reheater in a flue gas pass having at least first and second or final stages (possibly more), includes means for controlling the temperature of the second or final stage of the reheater comprising of a means for bypassing a selected portion of cold steam around said first stage reheater directly to said second or final stage reheater.

BRIEF DESCRIPTION OF THE DRAWING

The above and other objects and advantages of the present invention will become apparent from the following description when read in conjunction with the accompanying drawings wherein.

DETAILED DESCRIPTION OF A PREFERRED EMBODIMENT

Figure 1:
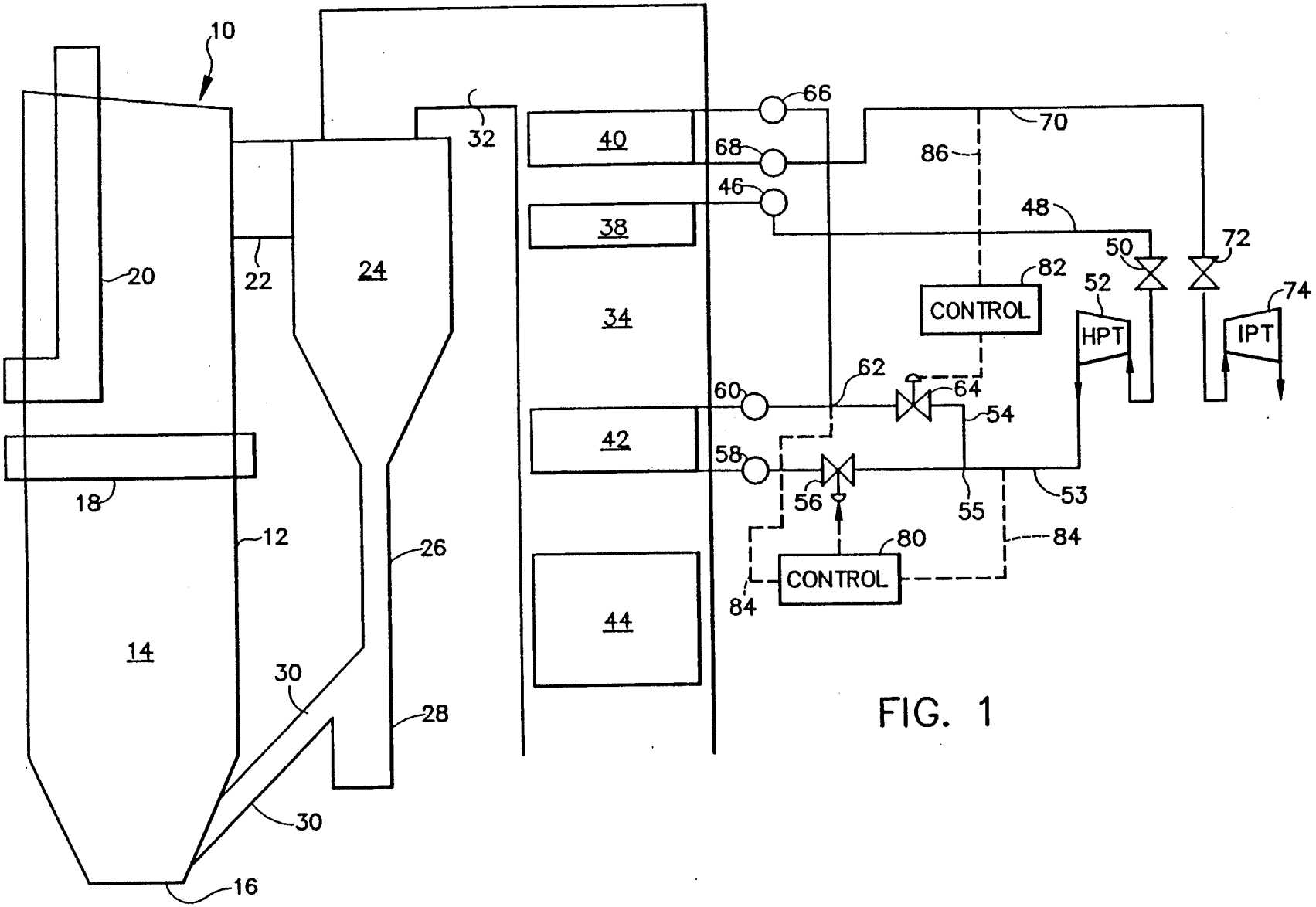
FIG. 1 is a schematic diagram illustrating a typical circulating fluidized bed boiler system embodying the present invention.

Referring to FIG. 1, a power plant embodying a typical circulating fluidized bed boiler with superheater and reheater is illustrated, with the system incorporating a preferred embodiment of the present invention. The boiler system, designated generally by the numeral 10, comprises a fluid bed combustor 12 having a combustion chamber 14 into which combustible material, non-combustible material, possibly additives or recirculated material, primary air and secondary air are fed. In the combustion chamber, the bed is maintained in fluidized state by having the correct inventory of bed material and flow of air. The combustion chamber is provided with a bottom 16 having a grid-like construction through which fluidizing air is introduced. The combustion chamber walls are preferably constructed with membrane type tube walls, with or without a refractory covering.

First and second stages of superheaters 18 and 20 are located within the combustion chamber. The combustion chamber materials are carried from the combustion chamber by way of flues 22 to a hot separator 24, wherein the solids are separated from the flue gases for return by way of flues and flue system 26, 28 and 30 to the bottom of the combustion chamber for recirculation. These may be passed through fluidized bed coolers or the like prior to return to the combustion chamber.

The details of supply and circulation circuit for the feed water and the primary superheaters are not illustrated, as they do not form an essential part of the present invention.

Flue gases from the hot separator pass along by way of flue 32 to a convection pass 34. A single stage superheater 38 is placed or located in the convection pass, with reheaters 40 and 42 located upstream of the superheater 38 and upstream of an economizer surface 44. This is in contrast to our prior application in which the superheater was upstream of the reheaters 40 and 42. The present placement of the second stage 40 of the reheater upstream of the superheater 38 allows it to pick up more heat at lower loads. This gives it the potential to extend its steam temperature control range, while having little if any effect on the superheater control range. This potential extension of the reheat steam temperature control range will enhance the coupling of two units to one turbine easier as to temperature matching capabilities.

The reheater is illustrated as two stages, with 42 being a first stage and 40 being a second or final stage. The reheater may have more than two stages, with the final stage just up stream from superheater 38, such as 40 is presently located. The reheater section 42 is arraned as a counter flow heat exchanger, with the gas flow direction down and the reheat steam flow direction up. The placement of the superheater 38 within this pass helps keep the temperature of the gas flow to reheater 42 below the critical temperature. This arrangement together with the bypass feature, as will be explained, enables a unique and effective control of the temperatures within the reheater sections.

When the steam temperature leaving the particular section (in a counter flow heat exchanger arrangement) is close to the gas temperature entering that section, reducing the steam flow to that section will result in a considerable reduction in heat absorption. As the steam temperature approaches the gas temperature, the effective thermal head available for heat transfer is reduced. This provides the basis for the principle used for the reheat temperature control system in accordance with our prior system and also the present invention.

The generating system, as illustrated in FIG. 1, is supplying steam to a two-stage turbine. In the illustrated arrangement, steam from superheater 38 flows via an outlet header 46 and supply line 48 by way of valve 50 to the inlet side of the high pressure turbine (HPT) 52. Cold steam leaving the turbine 52 returns by way of return line 53 to the reheaters 42 and 40. At the reheater, a bypass line 54 joins the return line 53 at 55 and bypasses a portion of the cold steam, with the remaining portion of the steam going by way of differential control valve 56 to the inlet header 58 of the first stage reheater 42.

The steam passing through the reheater 42 exits by way of a header 60 and rejoins or recombines with the bypass portion of the cold steam at 62. A flow control valve 64 is provided in the bypass line 54 for control of the flow between the inlet manifold of the first stage reheater 42 and the bypass line. The recombined steam at 62 flows into inlet header 66 of the second or final stage reheater 40, where it is further heated and flows by way of outlet header 68, supply line 70 and valve 72 to the second stage or lower stage of the turbine (IPT) 74. The selective proportioning of the cold steam between the bypass line 54 and the second stage of the reheater 42 provides an effective and efficient means of controlling the temperature in the reheater stages. The present arrangement, with reheater 40 up stream of superheater 38, gives even greater control over the temperature in the reheater stages.

The location of the first stage reheater 42 along the flue gas path is so chosen that bypassing the required portion of the cold reheat steam directly to the second stage reheater 40 cannot increase the steam temperature, leaving the first stage reheater to more than the allowed metal temperature for the reheater tube material. A limit will be set to protect the first stage reheater materials from exceeding their allowable metal temperature. The value of 1050 F. is a typical limit and may vary depending upon the actual design conditions. The purpose of the system is such that the maximum tube outside surface temperature will not exceed the allowable metal temperature limit for the material selected.

The arrangement of the control valves 56 and 64 is so chosen that controlability is achieved throughout the steam temperature control range and permits all reheater surfaces to be placed in the convection pass of the boiler, eliminating the need for in furnace reheater surfaces. This also makes feasible a simplified start-up scheme when more than one boiler for example is connected to a common turbine system. In this arrangement, the set of valves provides a means for reheat steam flow balancing under various operating conditions.

In the circulating fluidized bed boiler, the combustion takes place in a fluidized bed of inert material. The fluidized bed material leaving the combustor is returned by means of a hot collector (such as a hot cyclone) through suitable sealing device. In operation, air and fuel are delivered to the combustion chamber 14, wherein the bed material is maintained in a fluidized state by having the correct flow of air and bed material. The fluidizing air is introduced through a grid-like grating or construction at 16 in the bottom of the chamber. The flue gas and combustion products, along with the carry over solids, first convey heat to the superheaters 18 and 20 and are conveyed by way of flue 22 into the hot separator 24, wherein the solids are separated and returned to the combustion chamber through the flue arrangement 26, 28 and 30. The hot flue gases are then conveyed from the hot separator(s) by way of flue 32 to the convection pass section 34, wherein the final stage superheater 38 and the reheater stages 40 and 42 are located.

Three superheater stages are disposed in the described system, these being 18 and 20 and 38, with 38 being in the flue gas convection pass. Desuperheaters may be positioned between the superheater stages for steam temperature control if necessary. The two stages 40 and 42 of the reheater are positioned in the convection pass 34 and in conjunction with the control valves and interconnecting piping, so that precise control of the reheater outlet steam temperature is possible. The piping system is such that cold steam reentering this system at pipe 53 is selectively divided into two streams at the juncture 55 thereof with the bypass line 54. One stream passes to the first stage reheater and is distributed through inlet header 58. The other steam goes to the second stage reheater by way of valve 64 and inlet header 66. The selective division of the stream will be in proportion to the temperature control necessary, which is accomplished by the valves 56 and 64.

The hot steam leaving the first stage reheater from the outlet header 60 is mixed with the cold steam via the bypass line 54 after or down stream of the flow control valve 64, and the blended stream enters the second stage reheater by way of the inlet header 66. The flow through the first stage reheater is controlled by proper manipulation of the two control valves 56 and 64, which in turn control the steam temperature leaving the second stage reheater 40. Hot steam from the second or final stage reheater 40 is directed back to the turbine by way of the hot reheat steam line 70.

A differential pressure responsive control unit 80 controls the setting of valve 56 for controlling the pressure differential available for the control valve 64. The control unit 80 is responsive to the pressure differential between the cold steam return line 53 and the outlet pressure at juncture 62 of the outlet of reheater 42 and the bypass line 54. This is indicated by phantom line 84 in FIG. 1. The control unit 80 is set to control the valve 56 as a function of load on the boiler.

The valve 64 in the bypass line 54 is controlled by temperature responsive control unit 82, which responds to the temperature of the outlet steam from the second or final stage reheater 40. This control connection is indicated by phantom line 86 in FIG. 1. In the illustrated embodiment, as an example, the temperature of reheater 40 is maintained within the limit of about 1000 degrees F., plus or minus 10 degrees F. As the temperature of the steam leaving reheater 40 begins to increase above 1010 F., the valve 64 is opened to bypass additional cold steam directly to reheater 40. As the temperature begins to fall below 990 F., the valve 64 is closed to reduce the flow of bypass cold steam to the second stage 40.

Figure 2:
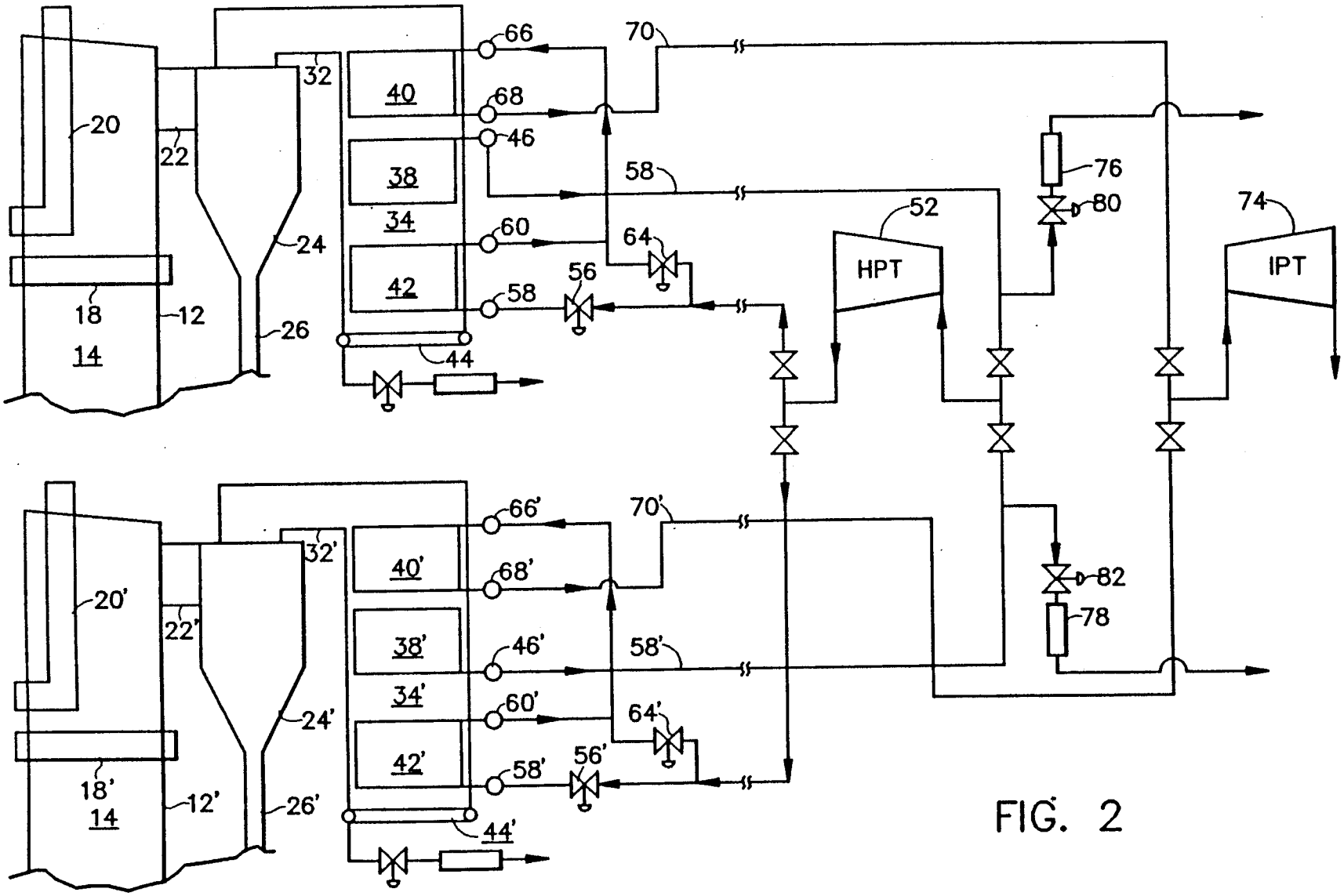
FIG. 2 is a schematic diagram illustrating an arrangement of two typical boilers connected to a single turbine.

Referring to FIG. 2, a system identical to FIG. 1, but with a duplicate boiler, is disclosed. In this system, the components of the first boiler arrangement are identified by the same reference numerals as in FIG. 1, with the second boiler arrangement being identified with the same numbers primed. Therefore, in this arrangement, a boiler turbine system is disclosed wherein two boilers are supplying steam to a single turbine. One essential feature required for this type of system is that means be provided for controlling the amount of reheat steam flow to each boiler, so that the steam temperature at reheat outlet is within limits at all possible operating conditions. In the illustrated system, duplicate controls and piping are provided for the two boilers.

The control valves 56 and 64 for the reheat steam temperature control can be used for flow balancing and maintaining the reheater outlet temperature within limits under both normal and abnormal operating conditions. In this arrangement, pressure reducing valves 80 and 82, along with desuperheaters 76 and 78, provide for flexibility during cold start-up, hot start-up and also when starting the second unit while the first one is on line. This simple system eliminates the need for a sophisticated steam blending system. It provides a simple and effective system and method for reheat outlet steam temperature control under varying load conditions.

In operation, from a cold start, combustion is initiated in the combustion chamber 14 with the introduction of fuel and combustion air. As heat is generated as a result of the combustion, the hot gases of combustion move upward in the combustion chamber, transferring heat to the water in the combustion chamber walls and to superheaters 18 and 20. The hot gas, combustion products, and solids pass from the combustion chamber along flue 22 into the hot separator 24, where the solids are separated for return to the combustion chamber.

The cleaned hot flue gas passes along flue 32 into the the convection pass 34, where the heat is transferred in sequence to the second or final stage reheater 40, the superheater 38, and the first stage reheater 42. The flow of hot gas through the system begins before the flow of cold steam. The boiler is fired and fuel burns for a period of time, providing hot gas before steam is generated and starts the turbine. Cold reheat steam doesn't start flowing until after the turbine starts, and the exhaust or cold steam starts flowing from the turbine.

As the hot gases give up their heat to the water and steam in the water walls, in superheaters and reheaters, the temperature drops so that it is less at each successive stage. It should be noted that the gas temperature leaving the combustion chamber outlet at full load will be in the range of 1550 degrees F. to 1700 degrees F. The greater the temperature differential between the gas and the water, the greater the heat transfer will be, and the cooler the gas will be as it passes from the respective heater. Therefore, as the gas now passes reheater 40 before it passes superheater 38, it may not be below the critical temperature for reheater 40 up to some load of the boiler. Thus, with superheater 38 in the gas pass behind the reheater 40, the gas temperature will be below the critical temperature for reheater 40 only until after about 25% to 30% load is reached. At this time, cold steam is available for control of the temperature in accordance with this invention. If a higher load point is required, the tube metal materials could be upgraded to allow a maximum load of about 35% to 40%.

This point of not requiring flow through the reheater until the unit is at 25% to about 40% load is another advantage of this invention. Most standard systems require flow through the reheater during the earlier stages of start-up (hot or cold), to protect them from burn out. Thus, an expensive bypass system must be utilized. However, with this system's physical layout, a bypass is not required, and system start-up periods can be shortened and reheat temperature range extended.

Other modifications and changes are possible in the foregoing disclosure and in some instances, some features may be employed without the corresponding use of other features. Accordingly, while the present invention has been illustrated and described with respect to specific embodiments, it is to be understood that numerous changes and modifications may be made therein without departing from the spirit and scope of the invention as defined in the appended claims.

We claim:

1. A power plant including a steam generator having a fluidized bed combustion system that includes a fluidized bed combustor, at least one separator, and further comprising in combination:

a first stage reheater;

a second stage reheater;

a superheater downstream of said second stage reheater;

means for dividing cold steam from a turbine into selective first and second portions and directing said first portion through said first stage reheater; and means for recombining said first and second portions and directing same through the second stage reheater.

2. A steam generator according to claim 1 wherein:
said means for dividing said cold steam comprises a bypass line with at least one flow control valve, and at least one pressure control valve at the inlet to the first stage of reheat.

3. A steam generator according to claim 1 wherein:
said first stage reheater and said second stage reheater are sequentially disposed with said superheater in a common gas flue.

4. A steam generator according to claim 1 wherein:
said means for dividing is temperature responsive.

5. A steam generator according to claim 1 wherein:
said gas flue includes at least superheater and economizer sections.

6. A steam generator according to claim 2 wherein:
said first stage reheater and said second stage reheater are sequentially disposed with said reheater in a common gas flue.

7. A steam generator according to claim 6 wherein:
said means for dividing is temperature responsive.

8. A steam generator according to claim 7 wherein:
said gas flue includes at least a superheater and economizer sections in sequence with said reheaters.

9. A steam generator according to claim 7 wherein:
said temperature of said second stage reheater is maintained at about 1000 degrees F., plus or minus 10 degrees F.

10. In a steam generator having a fluidized bed combustion system that includes a fluidized bed combustor, at least one hot separator, and a reheater in a flue gas pass having a plurality of stages including at least first and final stages, the improvement comprising:
a superheater disposed down stream of the final stage reheater;
means for controlling the steam temperature of the final stage reheater comprising means for bypassing a selected portion of cold steam from a turbine around the first stage of said reheater directly to the final stage of said reheater.

11. A steam generator according to claim 10 wherein:
said means for controlling comprises means for separating said cold steam into selective first and second portions and for directing said first portion through the first stage of said reheater; and
means for recombining said first and second portions and directing same through the final stage of said reheater.

12. A steam generator according to claim 10 wherein:
said means for controlling comprises a bypass line and valve means in said bypass line.

13. A steam generator according to claim 10 wherein:
said means for controlling comprises a bypass line for bypassing a portion of said cold steam, a differential pressure responsive valve between said bypass-line and inlet of the first stage of said reheater, and a temperature responsive valve in the bypass line between the cold steam supply line and an outlet line of the first stage of said reheater.

14. A power plant comprising in combination:
a two stage steam turbine;
a steam generator plant having a combustion chamber and a plurality of steam heating units including first and second stage reheaters and a superheater down stream of the second stage reheater disposed in a common gas flue; and
a system of steam lines for conducting steam between said steam generator and said turbine, including means for returning cold steam from said turbine to said first and second reheaters including dividing means for selectively dividing said cold steam into selective first and second portions and directing said first portion through said first stage reheater and combining means for recombining said first and second portions and directing the same through said second stage reheater.

15. A power plant according to claim 14 wherein:
said means for dividing said cold steam comprises a bypass line and at least one pressure responsive control valve.

16. A steam generator according to claim 14 wherein:
said means for dividing said cold steam comprises a bypass line and at least one temperature responsive control valve in said bypass line responsive to outlet temperature of said second stage reheater.

17. A steam generator according to claim 15 wherein:
said means for dividing said cold steam comprises a bypass line and at least one temperature responsive control valve in said bypass line responsive to outlet temperature of said second stage reheater.

18. A steam generator according to claim 17 wherein:
said gas flue includes at least a superheater and economizer sections.

19. A steam generator according to claim 17 wherein:
said pressure responsive valve is responsive to the difference between the return steam pressure and the outlet steam pressure of said first stage reheater.

20. A method of controlling reheater temperatures in a steam generator comprising the steps of:
providing a steam generator having a fluidized bed combustion system that includes a fluidized bed combustor, at least one hot separator, a superheater, and a reheater having first and second stages;
positioning said superheater downstream of said second stage reheater;
dividing cold steam returning to said reheater into selective first and second portions and directing said first portion through said first stage of said reheater; and
recombining said first and second portions and directing same through said second stage of said reheater.

21. A method according to claim 20 wherein:
said means for dividing said cold steam comprises a bypass line extending between an inlet and an outlet of the first stage of the reheater.

22. A method according to claim 20 including:
the step of disposing said reheater and said first and second stages of said reheater in a common gas flue.

23. A method according to claim 20 wherein:
said means for dividing is temperature responsive.

24. A method according to claim 20 wherein:
said gas flue includes at least a superheater section preceding said first stage reheater and an economizer section following said reheater.

25. A method according to claim 21 wherein:
said reheater and said first and second stages of said reheater are disposed in a common gas flue.

26. A method according to claim 25 wherein:
said means for dividing includes valve means that is temperature responsive.

27. A method according to claim 26 wherein:
said gas flue includes at least a superheater section preceding said first stage reheater and an economizer section following said reheater.

* * * * *